US005803818A

United States Patent [19]

Tseng

[11] Patent Number: 5,803,818

[45] Date of Patent: Sep. 8, 1998

[54] SWING

[75] Inventor: Chuen-Jong Tseng, Chiayi Hsien, Taiwan

[73] Assignee: Shin Yen Enterprises Co., Ltd., Taipei, Taiwan

[21] Appl. No.: 867,439

[22] Filed: Jun. 2, 1997

[51] Int. Cl.[6] ..... A63G 9/12

[52] U.S. Cl. ..... 472/118; 472/125; 384/275

[58] Field of Search ..... 472/118, 119, 472/120, 121, 125; 297/273, 277, 281; 403/65, 71, 119; 384/273, 903

[56] References Cited

U.S. PATENT DOCUMENTS

| | | | |
|---|---|---|---|
| 244,192 | 7/1881 | Crandal | 384/273 |
| 2,036,978 | 4/1936 | Anderson | 384/273 |
| 3,271,029 | 9/1966 | Grudoski | 472/118 |
| 5,163,828 | 11/1992 | Coddington, Jr. | 472/118 |

*Primary Examiner*—Kien T. Nguyen
*Attorney, Agent, or Firm*—Brinks Hofer Gilson & Lione

[57] ABSTRACT

A swing includes a swing frame, a seat member and a pair of generally C-shaped coupling units. The swing frame includes left and right upright side frames and a horizontal connecting rod which interconnects top ends of the side frames. The seat member is disposed between the side frames and has a pair of upwardly extending swing arms, each of which has a distal top end formed with an inverted U-shaped hook that opens downwardly toward the connecting rod. The coupling units are clamped spacedly and fittingly on the connecting rod. The hooks on the swing arms of the seat member engage slidably and respectively the coupling units on the connecting rod to permit forward and rearward swinging movement of the seat member relative to the connecting rod. The coupling units prevent direct contact between the hooks on the swing arms and the connecting rod to minimize wearing between the hooks and the connecting rod and to reduce noise that is generated when the seat member swings.

7 Claims, 5 Drawing Sheets

SWING

BACKGROUND OF THE INVENTION

1. Field of the Invention

The invention relates to a swing, more particularly to a swing with a stable and durable construction.

2. Description of the Related Art

Referring to FIG. 1, a conventional swing 1 is shown to comprise left and right upright side frames 10, a horizontal connecting rod 11 which interconnects top ends of the side frames 10, a seat member 13 between the side frames 10, and a pair of tension springs 12 which suspend the seat member 13 on the connecting rod 11 to permit forward and rearward swinging movement of the seat member 13 relative to the connecting rod 11. The swing 1 further comprises a shading frame 14 mounted securely on the connecting rod 11 to provide protection from sun and rain.

It is noted that spring fatigue of the tension springs 12 eventually occurs after long term use of the conventional swing 1. Thus, the tension springs 12 are unable to maintain the seat member 13 in an initial position, thereby resulting in discomfort and a feeling of instability when the swing 1 is in use. In addition, the inclination of the shading frame 14 cannot be adjusted to correspond with the position of the sun during different times of day.

SUMMARY OF THE INVENTION

The main object of the invention is to provide a swing with a stable and durable construction.

Another object of the invention is to provide a swing with a shading frame, the inclination of which can be adjusted to correspond with the position of the sun at different times of day.

Accordingly, the swing of the present invention comprises:

- a swing frame including left and right upright side frames and a horizontal connecting rod which interconnects top ends of the side frames;
- a seat member disposed between the side frames, the seat member having a pair of upwardly extending swing arms, each of which has a distal top end formed with an inverted U-shaped hook that opens downwardly toward the connecting rod;
- a pair of generally C-shaped coupling units clamped spacedly and fittingly on the connecting rod, the hooks on the swing arms of the seat member engaging slidably and respectively the coupling units on the connecting rod to permit forward and rearward swinging movement of the seat member relative to the connecting rod, the coupling units preventing direct contact between the hooks on the swing arms and the connecting rod to minimize wearing between the hooks and the connecting rod and to reduce noise that is generated when the seat member swings; and
- a shading frame mounted adjustably on the top ends of the side frames to permit adjusting of inclination of the shading frame relative to the swing frame.

Preferably, the top end of each of the side frames is provided with a first adjusting unit which has an engaging face that is formed with a plurality of radial first engaging teeth. The shading frame is provided with a pair of second adjusting units, each of which is aligned with the first adjusting unit on a respective one of the side frames and has an engaging face formed with a plurality of radial second engaging teeth. Each of a pair of fasteners extends through the shading frame, an aligned pair of the first and second adjusting units, and one of the side frames to mount loosely the shading frame on the side frames such that the second engaging teeth engage releasably the first engaging teeth to permit retention of the shading frame at a desired inclination relative to the swing frame and such that the shading frame can be forced to pivot relative to the swing frame so as to force the second engaging teeth to move past the first engaging teeth when varying the inclination of the shading frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
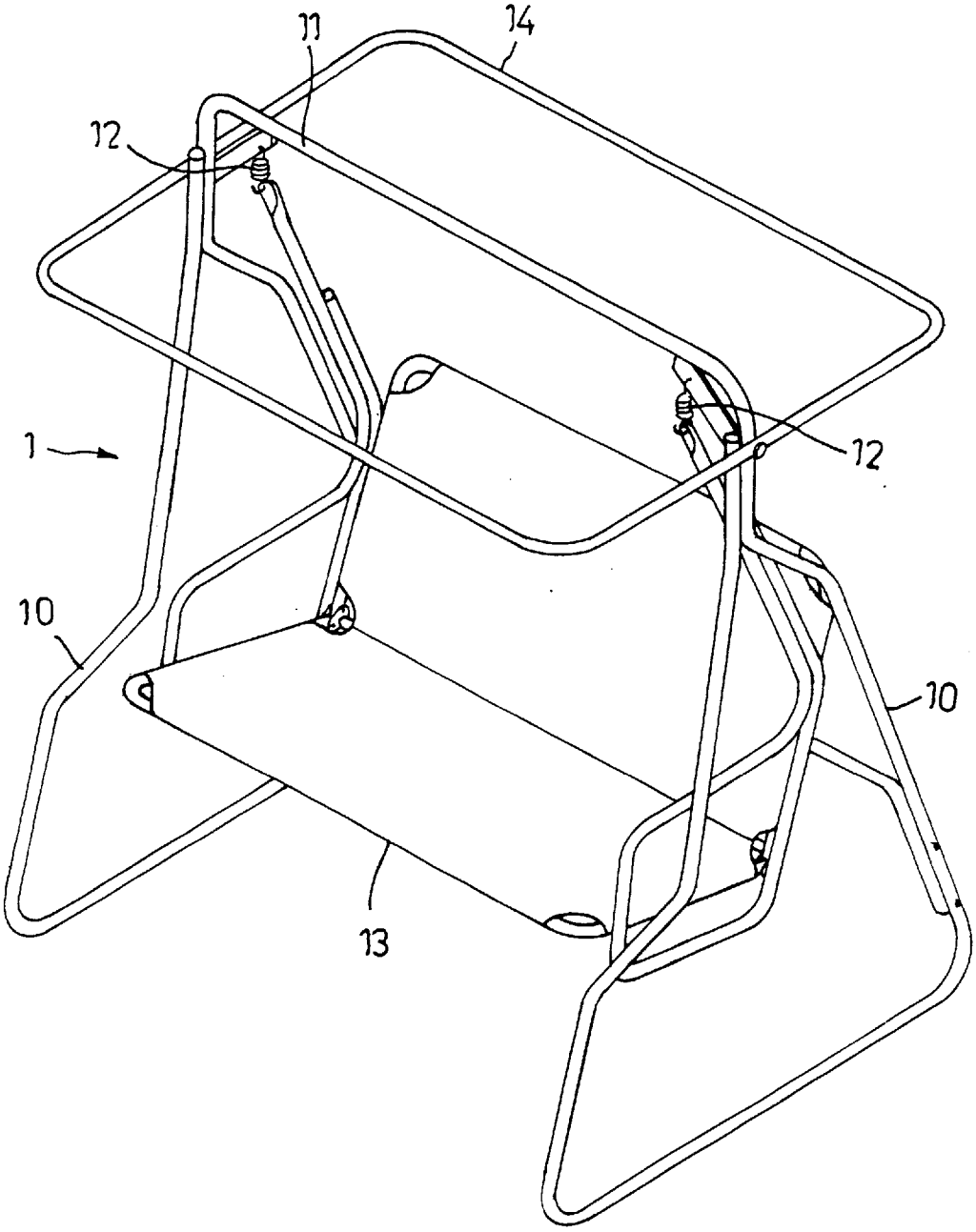
FIG. 1 PRIOR ART
FIG. 1 is a perspective view of a conventional swing.
Figure 2:
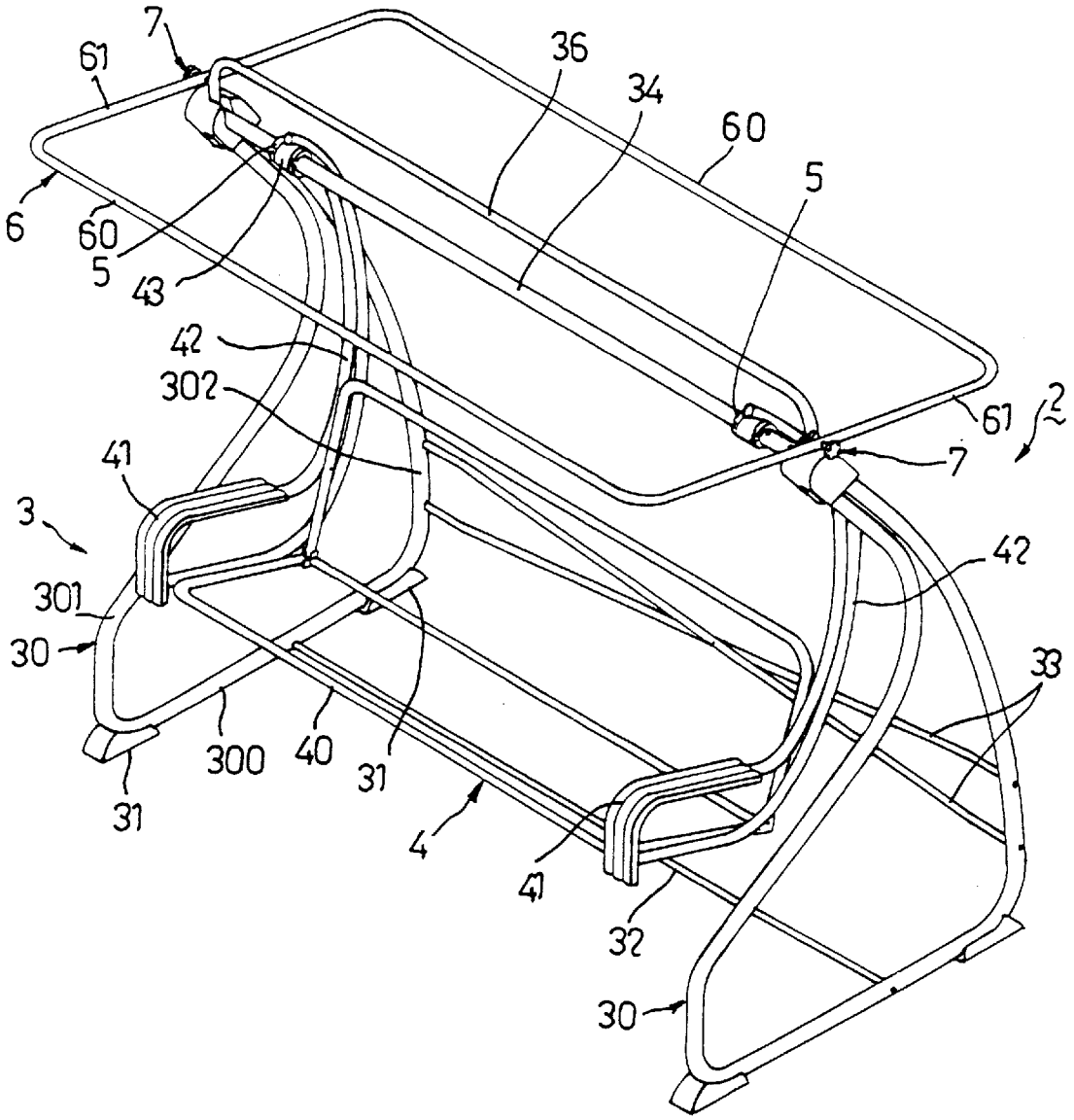
FIG. 2 is a perspective view of the preferred embodiment of a swing according to the present invention.

Referring to FIG. 2, the preferred embodiment of a swing 2 according to the present invention is shown to comprise a swing frame 3, a seat member 4, a pair of coupling units 5, a shading frame 6 and a pair of fasteners 7.

Figure 3:
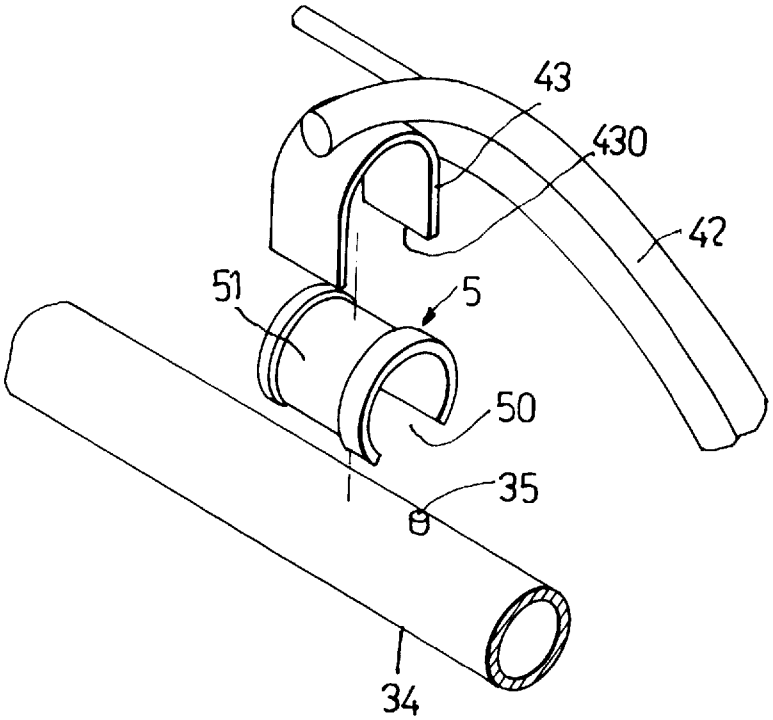
FIG. 3 is an exploded perspective view which illustrates the connection between a seat member and a swing frame of the preferred embodiment.

The swing frame 3 includes left and right upright side frames 30, each of which has a horizontal bottom part 300 and front and rear vertical parts 301, 302 which curve upwardly and respectively from front and rear ends of the bottom part 300. The bottom part 300 is provided with a pair of foot posts 31. A linking rod 32 interconnects the bottom parts 300 of the side frames 30. A pair of bracing rods 33 are arranged in a cross-shaped formation and interconnect lower sections of the rear vertical parts 302 of the side-frames 30. A horizontal connecting rod 34 interconnects top ends of the rear vertical parts 302 of the side frames 30. As shown in FIGS. 2 and 3, the connecting rod 34 has a spaced pair of radial stops 35 provided thereon. Preferably, the stops 35 are provided removably on the connecting rod 34, such as by insertion via radial pin holes in the connecting rod 34.

Figure 4:
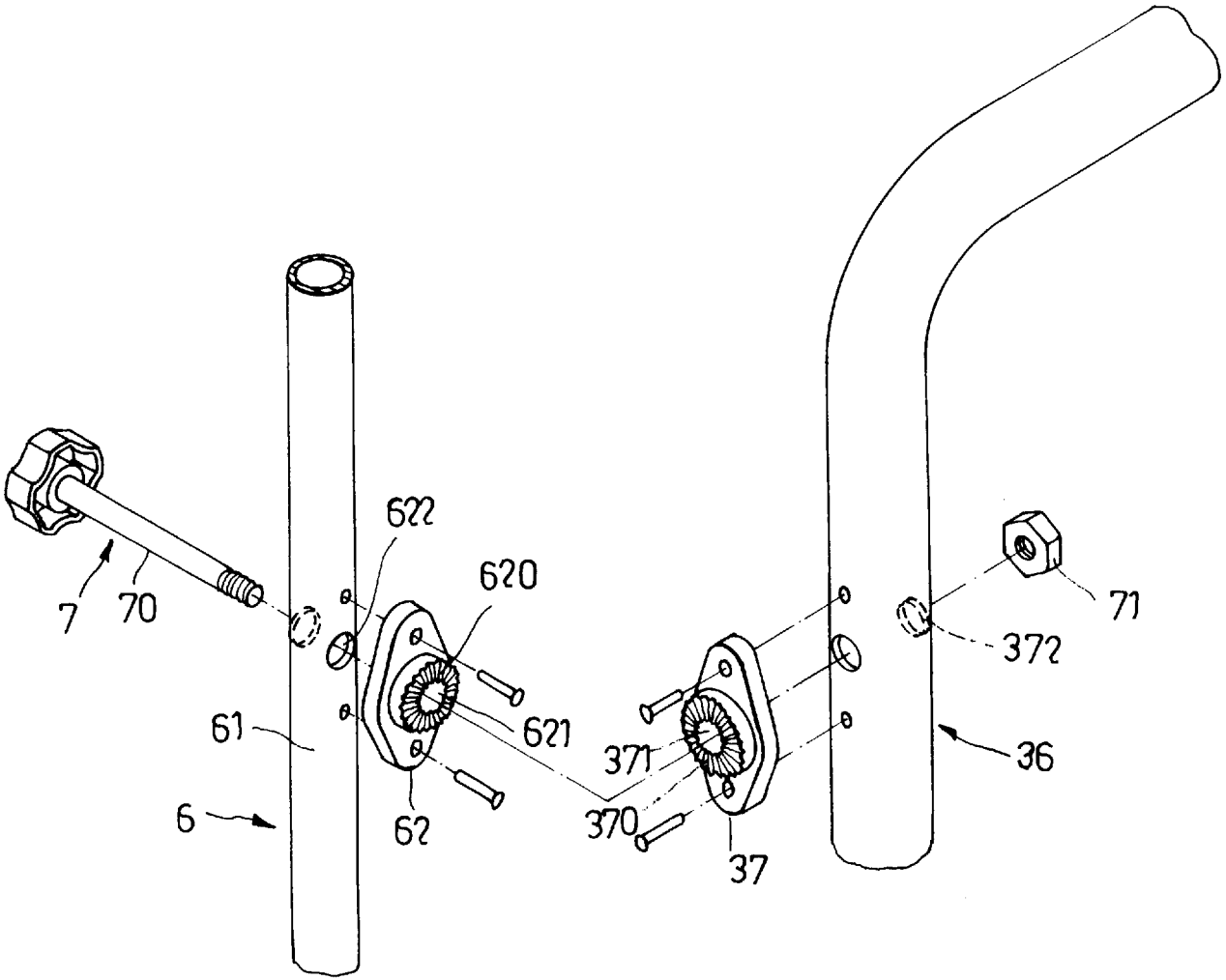
FIG. 4 is an exploded perspective view which illustrates the connection between a shading frame and the swing frame of the preferred embodiment.

Referring to FIGS. 2 and 4, an upright connecting member 36 is inverted U-shaped and has opposite vertical end portions secured respectively onto the top ends of the side frames 30. The vertical end portions of the connecting member 36 have outer sides provided with a respective first adjusting unit 37. The first adjusting unit 37 has an engaging face formed with a plurality of radial first engaging teeth 370 that radiate from a common center. The first adjusting unit 37 is further formed with a fastener hole 371 which extends through the common center of the first engaging teeth 370 and which is aligned with a radial fastener hole 372 in the corresponding one of the vertical end portions of the connecting member 36.

Referring again to FIGS. 2 and 3, the seat member 4 is disposed between the side frames 30 and has a seat portion 40 for accommodating a person thereon, a pair of arm rests 41 mounted on opposite sides of the seat portion 40, and a pair of swing arms 42 which extend upwardly and respectively from a rear end of a respective one of the arm rests 41. Each of the swing arms 42 has a distal top end formed with a resilient inverted U-shaped hook 43 which has an access 430 that opens downwardly toward the connecting rod 34. The distance between the hooks 43 on the swing arms 42 is slightly smaller than the distance between the stops 35 on the connecting rod 34.

Each of the coupling units 5 is made of a resilient plastic material and is formed as a generally C-shaped clamp with an notched end 50. The coupling units 5 are clamped spacedly and fittingly on the connecting rod 34 and have outer surfaces formed with a respective peripheral slide groove 51. The hooks 43 on the swing arms 42 of the seat member 4 engage respectively the coupling units 5 via the access 430 and are slidable in the slide grooves 51 of the coupling units 5 to prevent lateral movement of the hooks 43 on the coupling units 5.

Referring once more to FIGS. 2 and 4, the shading frame 6 is formed as a rectangular looped frame which includes front and rear rods 60 and a pair of side rods 61 that interconnect the front and rear rods 60. Each of the side rods 61 has an inner side provided with a second adjusting unit 62 that is aligned with a respective one of the first adjusting units 37 on the connecting member 36. The second adjusting unit 62 has an engaging face formed with a plurality of radial second engaging teeth 620 that radiate from a common center. The second adjusting unit 62 is further formed with a fastener hole 621 which extends through the common center of the second engaging teeth 620 and which is aligned with a radial fastener hole 622 in the corresponding one of the side rods 61. The shape of the shading frame 6 should not be limited to a rectangular looped frame. A piece of canvas is secured onto the shading frame 6 to provide protection against sun and rain.

Each of the fasteners 7 includes a bolt 70 and a not 71. The bolt 70 extends through the fastener hole 622 in one of the side rods 61, the fastener holes 621, 371 in an aligned pair of the second and first adjusting units 62, 37, and the fastener hole 372 in one of the vertical end portions of the connecting member 36. The nut 71 engages one end of the bolt 70 to mount the shading frame 6 on the connecting member 36 such that the second engaging teeth 620 engage releasably the first engaging teeth 370 to permit retention of the shading frame 6 at a desired inclination relative to the swing frame 3.

Referring again to FIG. 2, during assembly, the coupling units 5 are clamped spacedly and fittingly on the connecting rod 34 via the notched ends 51 thereof and are disposed between the stops 35 on the connecting rod 34 such that an outer side of each of the coupling units 5 abuts against the adjacent one of the stops 35, thereby arresting lateral movement of the coupling units 5 away from each other on the connecting rod 34. The hooks 43 on the swing arms 42 of the seat member 4 are then engaged slidably with the coupling units 5 in the slide grooves 51 of the latter via the access 430, thereby permitting forward and rearward swinging movement of the seat member 4 relative to the connecting rod 34 while preventing lateral movement of the hooks 43 on the coupling units 5 to prevent, in turn, lateral movement of the seat member 4 on the connecting rod 34. The coupling units 5, which are made of plastic, prevent direct contact between the connecting rod 34 and the hooks 43 on the swing arms 42, which are made of metal, to minimize wearing therebetween and to reduce the noise that is generated when the seat member 4 swings. Finally, the fasteners 7 fasten loosely the first and second adjusting units 37, 62, the connecting member 36 and the shading frame 6 to complete assembly of the swing 2, as shown in FIG. 5.

Figure 5:
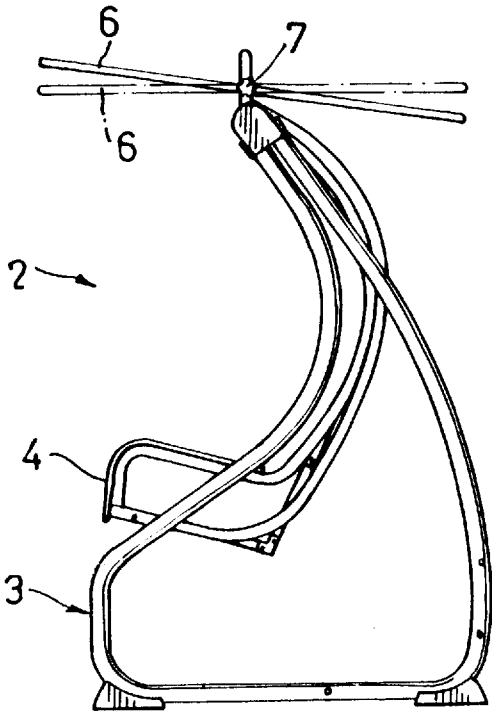
FIG. 5 is a schematic view of the preferred embodiment.

Referring to FIG. 5, since the first and second adjusting units 37, 62 are releasably engaged, the shading frame 6 can be forced to pivot upward or downward relative to the connecting member 36 so as to force the second engaging teeth 620 on the second adjusting unit 62 to move past the first engaging teeth 370 on the first adjusting unit 37, thereby varying the inclination of the shading frame 6 relative to the swing frame 3 so as to correspond with the position of the sun during different times of day.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing comprising:

a swing frame including left and right upright side frames and a horizontal connecting rod which interconnects top ends of said side frames;

a seat member disposed between said side frames, said seat member having a pair of upwardly extending swing arms, each of which has a distal top end formed with an inverted U-shaped hook that opens downwardly toward said connecting rod; and a pair of generally C-shaped coupling units clamped spacedly and fittingly on said connecting rod, said hooks on said swing arms of said seat member engaging slidably and respectively said coupling units on said connecting rod to permit forward and rearward swinging movement of said seat member relative to said connecting rod, said coupling units preventing direct contact between said hooks on said swing arms and said connecting rod to minimize wearing between said hooks and said connecting rod and to reduce noise that is generated when said seat member swings.

2. The swing of claim 1, wherein said coupling units are made of plastic.

3. The swing of claim 1, wherein said seat member further has a seat portion and a pair of arm rests mounted on opposite sides of said seat portion, each of said swing arms extending upwardly from a rear end of a respective one of said arm rests.

4. The swing of claim 1, wherein each of said coupling units has an outer surface formed with a peripheral slide groove, said hooks on said swing arms engaging slidably said coupling units in said slide grooves of said coupling units to prevent lateral movement of said hooks on said coupling units.

5. The swing of claim 1, wherein said connecting rod is provided with a spaced pair of radial stops to arrest lateral movement of said coupling units away from each other on said connecting rod.

6. The swing of claim 1, further comprising a shading frame mounted adjustably on said top ends of said side frames to permit adjusting of inclination of said shading frame relative to said swing frame.

7. The swing of claim 6, wherein:

said top end of each of said side frames is provided with a first adjusting unit which has an engaging face that is formed with a plurality of radial first engaging teeth;

said shading frame being provided with a pair of second adjusting units, each of which is aligned with said first adjusting unit on a respective one of said side frames and has an engaging face formed with a plurality of radial second engaging teeth;

said swing further including a pair of fasteners, each of which extends through said shading frame, an aligned pair of said first and second adjusting units, and one of said side frames to mount loosely said shading frame on said side frames such that said second engaging teeth engage releasably said first engaging teeth to permit retention of said shading frame at a desired inclination relative to said swing frame and such that said shading frame can be forced to pivot relative to said swing frame so as to force said second engaging teeth to move past said first engaging teeth when varying the inclination of said shading frame.

* * * * *